US008287286B2

(12) United States Patent
Miwa

(10) Patent No.: US 8,287,286 B2
(45) Date of Patent: Oct. 16, 2012

(54) ELECTRICAL INTERPOSER CONNECTION BODY

(75) Inventor: Kazuiku Miwa, Obu (JP)

(73) Assignee: NGK Insulators, Ltd., Nagoya (JP)

( * ) Notice: Subject to any disclaimer, the term of this patent is extended or adjusted under 35 U.S.C. 154(b) by 248 days.

(21) Appl. No.: 12/573,919

(22) Filed: Oct. 6, 2009

(65) Prior Publication Data

US 2010/0093190 A1 Apr. 15, 2010

(30) Foreign Application Priority Data

Oct. 9, 2008 (JP) ..... 2008-262493
Sep. 27, 2009 (JP) ..... 2009-197371

(51) Int. Cl.
*H01R 12/00* (2006.01)

(52) U.S. Cl. ..... 439/66

(58) Field of Classification Search ..... 439/66, 439/591, 65
See application file for complete search history.

(56) References Cited

U.S. PATENT DOCUMENTS 5,800,184 A * 9/1998 Lopergolo et al. ..... 439/66
7,263,770 B2 * 9/2007 Mendenhall et al. ..... 29/856
2008/0032521 A1 * 2/2008 Nikaido et al. ..... 439/73

FOREIGN PATENT DOCUMENTS

JP 2007-294384 A1 11/2007

* cited by examiner

*Primary Examiner* — Vanessa Girardi
(74) *Attorney, Agent, or Firm* — Burr & Brown

(57) ABSTRACT

In an electrical connection body, a carrier is formed with a through-hole and a wall portion formed upright by a groove portion on both sides of the through-hole, and a connector is provided with a first beam on one end of a connecting portion and a second beam on the other end of the connecting portion, and is also provided with regulating portions on both sides of the connecting portion on the side of the first beam. The regulating portions come into contact with the wall portion to regulate the axial rotation of the connector. The first beam and the second beam are bent with respect to the connecting portion and come into contact with respective opening portions of the through-hole, to thereby regulate the movement of the connector in the forming direction of the through-hole.

12 Claims, 17 Drawing Sheets

ELECTRICAL INTERPOSER CONNECTION BODY

BACKGROUND OF THE INVENTION

1. Field of the Invention

The present invention relates to an electrical connection body.

2. Description of the Related Art

Conventionally, an electrical connection body has been proposed which is configured such that a carrier is nipped and retained by a connector including a first beam having a first contact connected to one of facing electrodes and a second beam having a second contact connected to the other one of the facing electrodes (see Patent Document 1, for example). In the electrical connection body described in this Patent Document 1, a step portion is provided to the carrier, and a bent portion is formed in the connector, to thereby press the beams of the connector so that the bent portion of the connector nips and retains the step portion of the carrier. Accordingly, a simple retaining structure is provided, and it is easy to increase the number of provided connectors and reduce the pitch of the connectors.

[Prior Art Documents]

[Patent Documents]

[Patent Document 1] Japanese Unexamined Patent Application Publication No. 2007-294384(FIG. 12)

SUMMARY OF THE INVENTION

However, in the electrical connection body described in this Patent Document 1, the bent portion of the connector is required to more reliably nip the step portion of the carrier. Therefore, high processing accuracy is required for the step portion and the bent portion in some cases. Further, in a case in which facing devices press the first and second beams to have the bent portion of the connector nip the step portion of the carrier, the connector and the carrier are insufficiently fixed to each other in some cases due to the influence of springback of the connector in the production of the connector. Further, if a connector is used which is provided with a folded portion and a bent portion to prevent the springback and thus has a complicatedly folded and bent shape, there arises an issue of difficulty in inserting the connector into a through-hole formed in the carrier.

The present invention has been made in view of the above-described issues, and it is a primary object of the present invention to provide an electrical connection body which more reliably fixes a connector and a carrier to each other, and which is easier to produce.

The present invention employs the following means to achieve the above-described object.

In the present invention, an electrical connection body which electrically connects facing electrodes between two devices, the connection body includes a carrier including a through-hole and a wall portion provided upright in the vicinity of the through-hole in the forming direction of the through-hole, and a connector including a first beam having a first contact connected to one of the facing electrodes, a second beam having a second contact connected to the other one of the facing electrodes, a connecting portion having one end provided with the first beam and the other end provided with the second beam, and a regulating portion provided to the connecting portion to come into contact with the wall portion and regulate the movement of the connecting portion, the connector having the connecting portion inserted in the through-hole with the first beam and the second beam projecting from different surfaces of the carrier, wherein the regulating portion comes into contact with the wall portion to regulate the axial rotation of the connector.

In this electrical connection body, a carrier is formed with a through-hole and a wall portion provided upright, and a connector is provided with first and second beams at the opposite ends of a connecting portion, and is also provided with a regulating portion. In this electrical connection body, the axial rotation of the connector is regulated due to the contact between the regulating portion and the wall portion. Therefore, the axial rotation of the connector is more firmly regulated by the regulating portion and the wall portion. Accordingly, the connector and the carrier can be more reliably fixed to each other. Further, it suffices if the regulating portion is provided to the connecting portion, and thus the electrical connection body is more easily produced.

In this case, the connector may be configured such that at least one of the first beam and the second beam is bent with respect to the connecting portion and comes into contact with an opening portion of the through-hole, to thereby regulate the movement of the connector in the forming direction of the through-hole. With this configuration, the beam of the connector inserted in the through-hole is bent to bring the connector into contact with and fixed (to the through-hole due to component force of bending force). Therefore, the dimensional accuracy in the forming direction of the through-hole is more mitigated, and the connector can be more easily fixed.

In the electrical connection body of the present invention, the carrier may be configured such that the wall portion is formed on both sides of the through-hole, and the connector may be configured such that the regulating portion being a plate-like body is provided on both sides of the connecting portion. Herein, "both sides" may be, for example, both the left and right sides of the through-hole or both the left and right sides of the connecting portion. In this case, the connector may be configured such that the plate-like body is provided to be inclined from the connecting portion toward the wall portion. In the electrical connection body of the present invention, the connector may be configured such that the connecting portion and the regulating portion are integrally formed.

In the electrical connection body of the present invention, in the connector, the regulating portion may be provided to the first beam side of the connecting portion, and the connecting portion side of the second beam may be bent into an S-shape and in contact with an opening portion of the through-hole with at least a part of the S-shape located in the interior of the through-hole.

In the electrical connection body of the present invention, in the connector, the regulating portion may be provided to the first beam side of the connecting portion, and the second beam and the connecting portion before being inserted into the through-hole may be formed into a substantially flat plate shape.

In the electrical connection body of the present invention, the connector may be configured such that the regulating portion is provided to the first beam side of the connecting portion, and the carrier may be configured such that an opening portion of the through-hole provided to the first beam side is formed to be larger than an opening portion of the through-hole provided to the second beam side. In this case, the carrier may be configured such that the opening width of the through-hole is formed in a plurality of stages, to thereby form the opening portion provided with the first beam to be larger than the opening portion provided with the second beam. Further, the carrier may be configured such that the through-hole is formed into a tapered shape, to thereby form the opening portion provided with the first beam to be larger than the opening portion provided with the second beam.

In the electrical connection body of the present invention, the connector may include the regulating portion having a coil shape and applying spring force to the wall portion in the carrier to regulate the movement of the connecting portion. In this case, in the connector, a single wire rod may form the first beam, the second beam, the connecting portion, and the regulating portion. Further, in the connector, the first beam having a linear shape and the second beam having a linear shape may project from different surfaces of the carrier.

In the electrical connection body in the present invention, each of the first contact of the first beam and the second contact of the second beam may be formed into a circular arc shape projecting toward the electrode connected thereto.

In the electrical connection body in the present invention, in the carrier, the wall portion may be formed by a wall surface of a groove portion provided to overlap with a part of the through-hole.

In the electrical connection body of the present invention, the carrier may be configured such that the through-hole is formed in a plurality, and that the connector is inserted in each of the plurality of through-holes. In this case, the plurality of beams of the connector projecting from at least one of the surfaces of the carrier can be oriented toward the center of the carrier and face each other. Further, in the connector, at least one of the beams can have a solder ball and a land portion provided with the solder ball.

In the electrical connection body of the present invention, a bonding layer can be provided between the connector and the carrier. In the electrical connection body of the present invention, the rotation of the connector can be suppressed due to the contact between the regulating portion and the wall portion, and thus the bonding layer may not be provided.

In the electrical connection body of the present invention, it is preferable that the first beam and the second beam of the connector project from the carrier in a cantilever fashion. In this embodiment, it is preferable that the beam angle of each of the first beam and the second beam is 15° or more and 50° or less. Further, it is preferable that the ratio between the beam width and the beam length is 1 or more and 18 or less. Furthermore, it is preferable that the ratio between the beam thickness and the beam width is 2 or more and 40 or less.

In the electrical connection body of the present invention, it is preferable that the connector mainly includes a conductive material including one selected from beryllium copper, titanium copper, copper-nickel-tin alloy, copper-nickel-silicon alloy, and nickel-beryllium. Further, it is preferable that the carrier mainly includes an insulative material including one selected from elastomer, ceramics, and engineering plastic. The carrier may be a rigid body or an elastic body.

In the electrical connection body of the present invention, it is preferable that each of the devices includes the electrodes arranged in an array pattern. Further, it is preferable that the electrical connection body of the present invention is a socket or an interposer. According to the present invention, the electrical connection body of the present invention provides an electronic device including one of the above-described connection bodies. Such an electronic device includes an inspection device of a probe card, a semiconductor, and a chip. That is, the electrical connection body of the present invention may connect electrodes of electronic devices in the inspection or mounting of a probe card, a semiconductor, and a chip.

DETAILED DESCRIPTION OF THE INVENTION

First Embodiment

Figure 1:
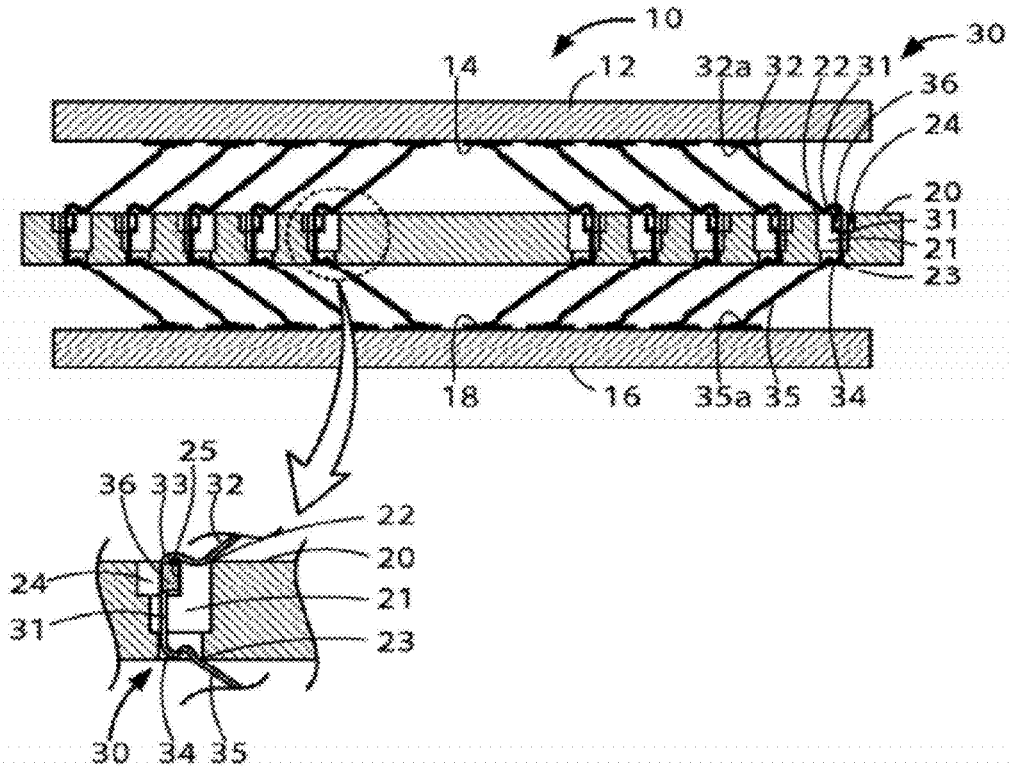
FIG. 1 is a cross-sectional view illustrating an overview of the structure of an electrical connection body 10, which is an embodiment the present invention.
Figure 2:
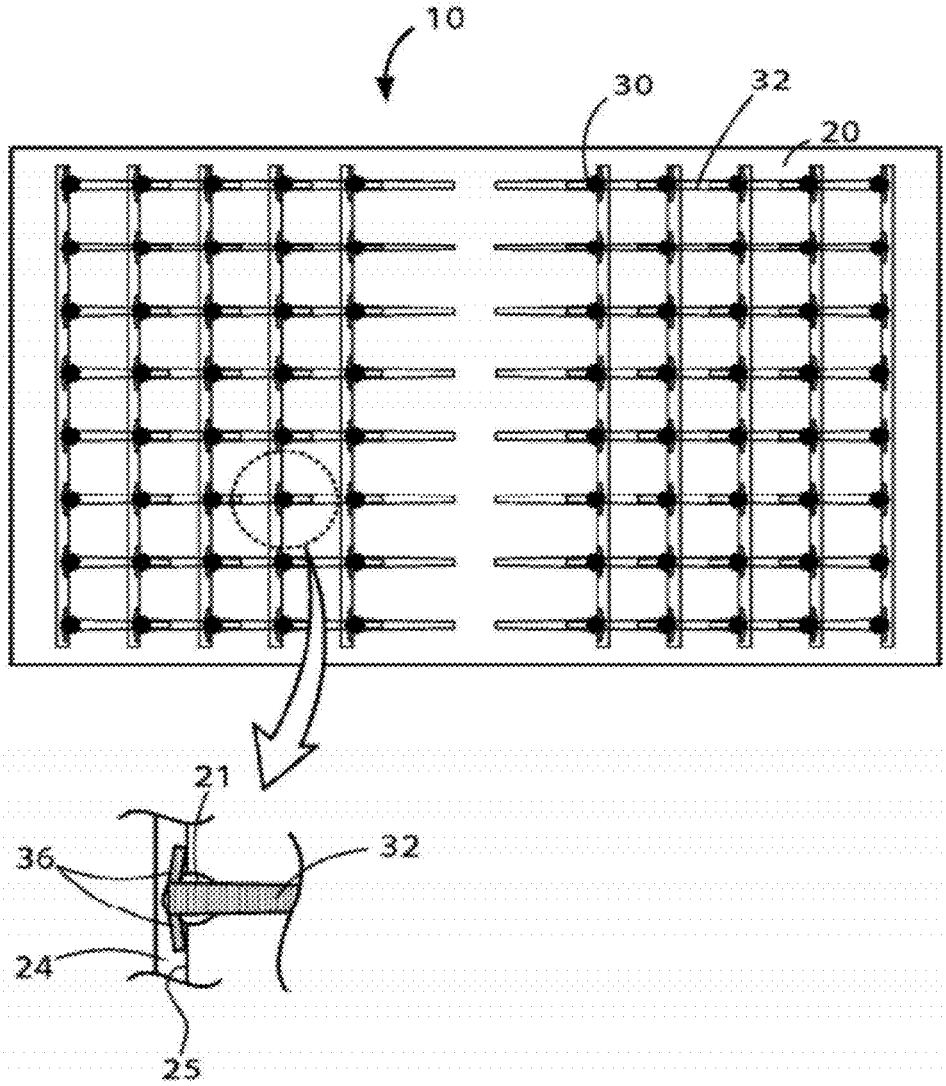
FIG. 2 is a plan view of the electrical connection body 10.
Figure 3:
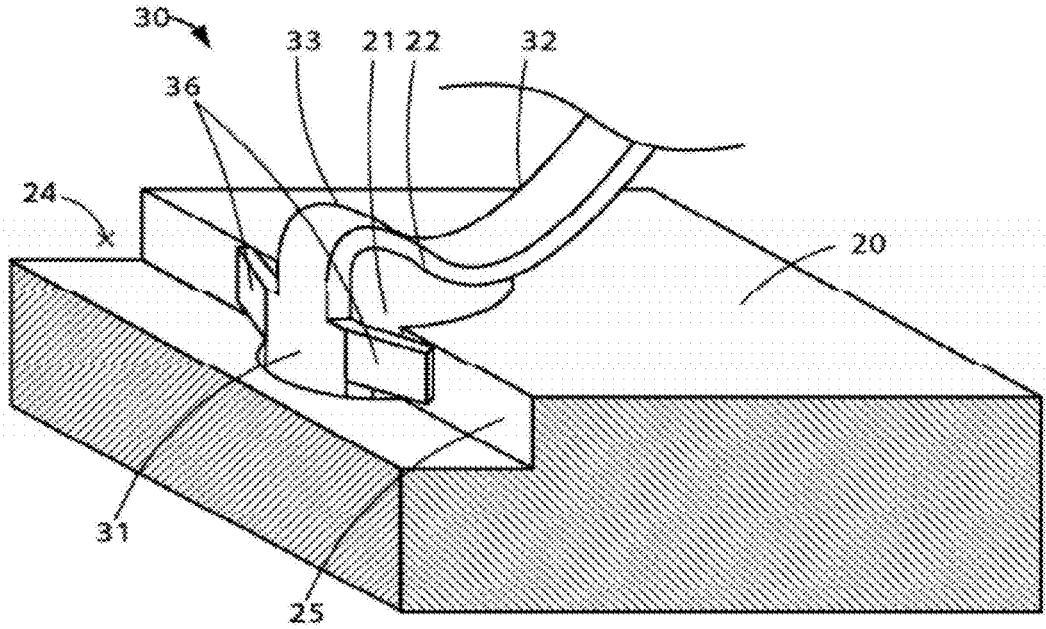
FIG. 3 is a perspective view illustrating a cross section of a part of the electrical connection body 10.
Figure 4:
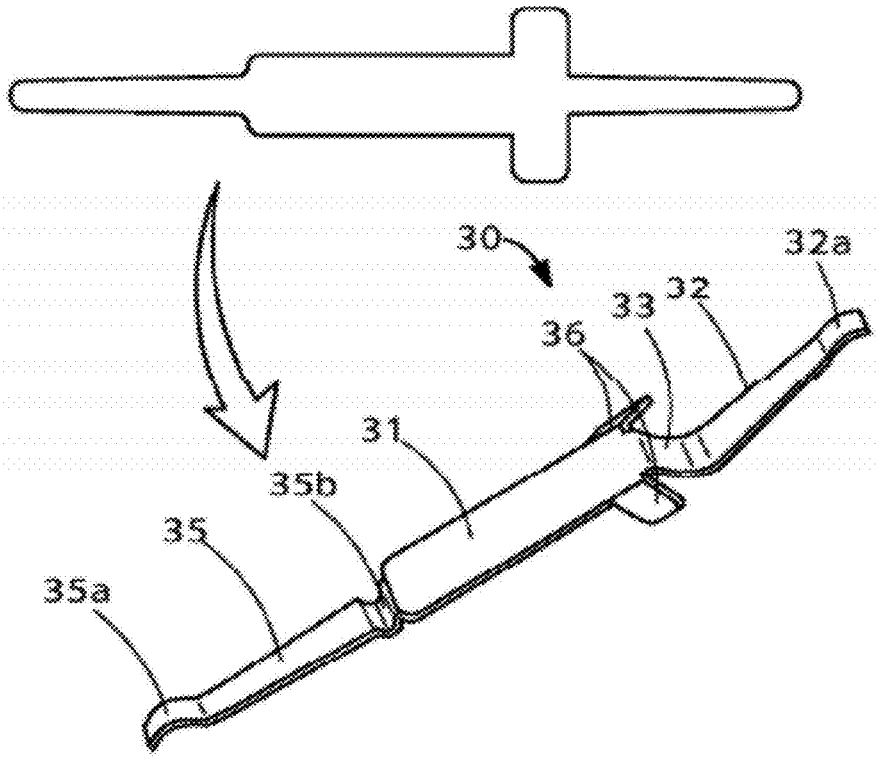
FIG. 4 is an explanatory diagram of a connector 30 included in the electrical connection body 10.

A first embodiment for implementing the present invention will then be described with reference to the drawings. FIG. 1 is a cross-sectional view illustrating an overview of the structure of an electrical connection body 10, which is an embodiment of the present invention. FIG. 2 is a plan view of the electrical connection body 10. FIG. 3 is a perspective view illustrating a cross section of a part of the electrical connection body 10. FIG. 4 is an explanatory diagram of a connector 30 included in the electrical connection body 10. As illustrated in FIG. 1, the electrical connection body 10 is configured to electrically connect a plurality of first electrodes 14, which are formed in an array pattern on a first device 12, and a plurality of second electrodes 18, which are formed in an array pattern on a second device 16 and face the first electrodes 14. The electrical connection body 10 includes a carrier 20 disposed between the first device 12 and the second device 16, and a plurality of connectors 30 provided to the carrier 20 to electrically connect the first electrodes 14 and the second electrodes 18. The electrical connection body 10 is used, being installed in an inspection device which inspects the state of electrical connection between the first device 12 and the second device 16. Devices subjected to the inspection include a probe card, a semiconductor, a chip, and so forth.

The carrier 20 is a rectangular plate-like body entirely formed by an insulative material, and is a member for retaining the connectors 30. It is preferable to use an insulative material such as elastomer, a plastic material, and a ceramics material, for example, to form the carrier 20. Although the above-described insulative material is not particularly limited, the insulative material includes silicon elastomer, glass fiber-containing epoxy resin such as FR4, engineering plastic such as polyetheretherketone (PEEK), and a variety of ceramics such as alumina and zirconia. The carrier 20 may be a rigid body or an elastic body. However, it is preferable that the carrier 20 is a rigid body to easily ensure the connectivity of the devices and the flatness and the dimensional accuracy of the carrier 20.

The carrier 20 is formed with a plurality of through-holes 21 formed in a matrix including rows and columns, and groove portions 24 provided for the respective columns of the through-holes 21 to overlap with parts of the through-holes 21 on the upper surface side of the carrier 20. The through-holes 21 are formed symmetrically on the opposite sides of a central portion halving the carrier 20 into the left and right sections. In each of the through-holes 21, a first opening portion 22 on the side of the later-described connector 30 formed with regulating portions 36 (the upper surface side of the carrier 20 in FIG. 1) is formed to be larger in opening diameter than a second opening portion 23 on the side of the connector 30 not formed with the regulating portions 36 (the lower surface side of the carrier 20 in FIG. 1). Herein, the through-hole 21 is formed to have two staged diameters, to thereby form the first opening portion 22 to be larger in opening diameter than the second opening portion 23. As illustrated in FIGS. 1 and 2, the through-holes 21 are separately formed for the individual connectors 30. However, the through-holes 21 may be formed into, for example, slits or the like such that a plurality of connectors 30 aligned in a column can be collectively retained. Each of the groove portions 24 is formed as a space having a rectangular cross section and communicating with the upper surface side of the through-holes 21 in the corresponding one of the columns. The groove portion 24 is provided in a direction perpendicular to the direction in which a first beam 32 of the connector 30 is oriented. Further, the groove portion 24 is formed to overlap with a part of the through-hole 21. Therefore, a wall portion 25 of the groove portion 24 on the side of the through-hole 21 is provided upright on both sides of the through-hole 21, i.e., on both the left and right sides of the through-hole 21 in the forming direction of the through-hole 21 (see FIG. 3).

The connector 30 is a conductive plate-like body having a shape bent into a cantilever-like, substantially C-shape, and serves as a member for electrically connecting the electrodes between the respective devices. It is preferable that the connector 30 mainly includes a conductive material including one selected from beryllium copper, titanium copper, copper-nickel-tin alloy, copper-nickel-silicon alloy, and nickel-beryllium. From the viewpoints of conductivity and durability, the use of beryllium copper is preferable. The surface of the above-described material may be subjected to base plating with nickel or the like and then to gold plating. The connector 30 can be obtained by punching a flat plate into a predetermined shape or by partially removing a flat plate by etching to process the plate into the predetermined shape (see the upper diagram in FIG. 4), and thereafter performing a process of folding and bending the plate into an intended shape (see the lower diagram in FIG. 4). The connector 30 includes a flat plate-like cantilever having a plate thickness corresponding to a spring thickness, and a flat plate-like cantilever having a plate width corresponding to a spring thickness. Preferably, the connector 30 is the flat plate-like cantilever having a plate thickness corresponding to a spring thickness. According to this type of flat plate-like cantilever, a sufficient cross-sectional area can be easily obtained. Therefore, the conductor resistance can be kept low. It is preferable that the plate thickness of the connector 30 is 0.01 mm or more and 0.08 mm or less. This is because, with the plate thickness set in this range, appropriate elasticity or flexibility can be obtained when the plate thickness corresponds to the spring thickness, and because favorable conductivity is easily obtained due to the relationship with the spring width. The plate thickness is more preferably 0.02 mm or more and 0.06 mm or less.

As illustrated in FIGS. 1 to 3, the connector 30 is formed with the first beam 32 having a first contact 32*a*, a second beam 35 having a second contact 35*a*, a connecting portion 31 provided with the first beam 32 on one end thereof and the second beam 35 on the other end thereof and inserted in the through-hole 21, and the regulating portions 36 provided on both sides of the connecting portion 31 on the side of the first beam 32. The beams of the connector 30 are provided to be oriented toward the center of the carrier 20 and face each other (see FIGS. 1 and 2). It is preferable that each of the first beam 32 and the second beam 35 is formed to have a beam width reduced from the side of the center of the connector 30 toward a tip thereof. With the reduction in beam width, it is possible to provide a large displacement while equalizing the surface stress of the connector 30 in the length direction of the beams. It is preferable that the beam angle of each of the first beam 32 and the second beam 35 is 15° or more and 50° or less. If the beam angle is 15° or more, it is possible to ensure the distance between one beam and another beam located in the falling direction of the one beam, and to obtain a necessary displacement while preventing adjacent beams from interfering with each other. Further, if the beam angle is 50° or less, it is possible to suppress an increase in the perpendicular component of a load when the beam comes into contact with the electrode and is displaced. Therefore, it is possible to suppress the application of excessive force due to the friction caused when the contact slides in contact with the electrode, and thus to suppress the deformation of the beam. Further, if the beam angle is 50° or less, it is possible to suppress an increase in slide amount in the horizontal direction of the contact with respect to the same displacement amount. Therefore, even with a narrow pitch, the contact can be reliably kept in contact with the electrode. More preferably, the beam angle is 30° or more and 40° or less. Further, it is preferable that the ratio between the beam width and the beam length (beam length/beam width) is 1 or more and 18 or less. If the ratio is 1 or more, the beam shape can be substantially maintained to be a quadrate shape. Therefore, the dimensional accuracy is easily ensured in a bending process. Further, if the ratio is 18 or less, it is possible to suppress an increase in the longitudinal length of the flat plate-like cantilever having a plate thickness corresponding to a spring thickness, and thus to suppress an increase in conductor resistance. The ratio is more preferably 2 or more and 12 or less, and further preferably 3 or more and 8 or less. The beam length refers to the length from a portion of a beam in contact with a surface of the carrier 20 to a tip of the beam. Further, it is also preferable that the ratio between the beam thickness and the beam width (beam width/beam thickness) is 2 or more and 40 or less. If the ratio is 2 or more, the superiority of the reduction in conductor resistance due to the increase in cross-sectional area is easily obtained. Further, if the ratio is 40 or less, it is possible to maintain the beam width within an allowable range with respect to the manageable plate thickness, and to maintain the fixed pitch of the connector 30 to be a predetermined value or less. The ratio between the beam thickness and the beam width is more preferably 3 or more and 20 or less, and further preferably 4 or more and 15 or less. Further, it is preferable that the beam width is 0.15 mm or more and 0.70 mm or less. This is because, with this range, favorable conductivity is easily obtained in terms of the relationship with the plate thickness described above. More preferably, the beam width is 0.15 mm or more and 0.50 mm or less. The beam length can be set to exceed the formation pitch of the through-holes 21. The beam length is preferably 120% or more with respect to the formation pitch of the through-holes 21, depending on the pitch of the through-holes 21. The beam length is more preferably 150% or more, further preferably 180% or more, and furthermore preferably 200% or more. Further, the beam length can be set to be 360% or more. In the present invention, the formation pitch of the through-holes 21 in the carrier 20 is preferably 0.5 mm or more and 2.54 mm or less, and more preferably 0.8 mm or more and 1.6 mm or less. Further, it is preferable that each of the first contact 32*a* and the second contact 35*a* is formed into a circular arc shape projecting toward the electrode connected thereto. With this configuration, the connection between the connector 30 and the electrodes is easily established.

A portion of the first beam 32 provided to the connecting portion 31 forms a bent folded portion 33. The folded portion 33 comes into contact with the first opening portion 22 (an opening edge) to regulate the movement of the connector 30 toward the lower side of the through-hole 21. Further, a portion of the second beam 35 provided to the connecting portion 31 forms an S-shaped portion 34 having a cross section bent into an S-shape. At least a part of the S-shaped portion 34 enters the interior of the through-hole 21 from the second opening portion 23. The S-shaped portion 34 of the second beam 35 comes into contact with the second opening portion 23 (an opening edge) to regulate the movement of the connector 30 toward the upper side of the through-hole 21.

The regulating portions 36 are flexible plate-like bodies provided on both sides, i.e., both the left and right sides of the connecting portion 31, and are members provided to be inclined from the connecting portion 31 toward the wall portion 25 of the groove portion 24 to press the connecting portion 31 in a direction separating from the wall portion 25. The regulating portions 36 have the characteristics of a spring due to the flexibility thereof. The regulating portions 36 come into contact with and press the wall portion 25 formed on both sides of the through-hole 21, to thereby fix the flat plate-like connecting portion 31 to be parallel to the forming direction of the wall portion 25 and regulate the rotation of the connector 30 in the axial direction. As illustrated in FIG. 4, the connecting portion 31, the first beam 32, the second beam 35, and the regulating portions 36 are integrally formed, and the respective members are folded and bent to form the connector 30. It suffices if the regulating portions 36 come into contact with the wall portion 25 to fix the connector 30. Thus, the regulating portions 36 may be configured not to have the flexibility and the function of a spring.

Figure 5:
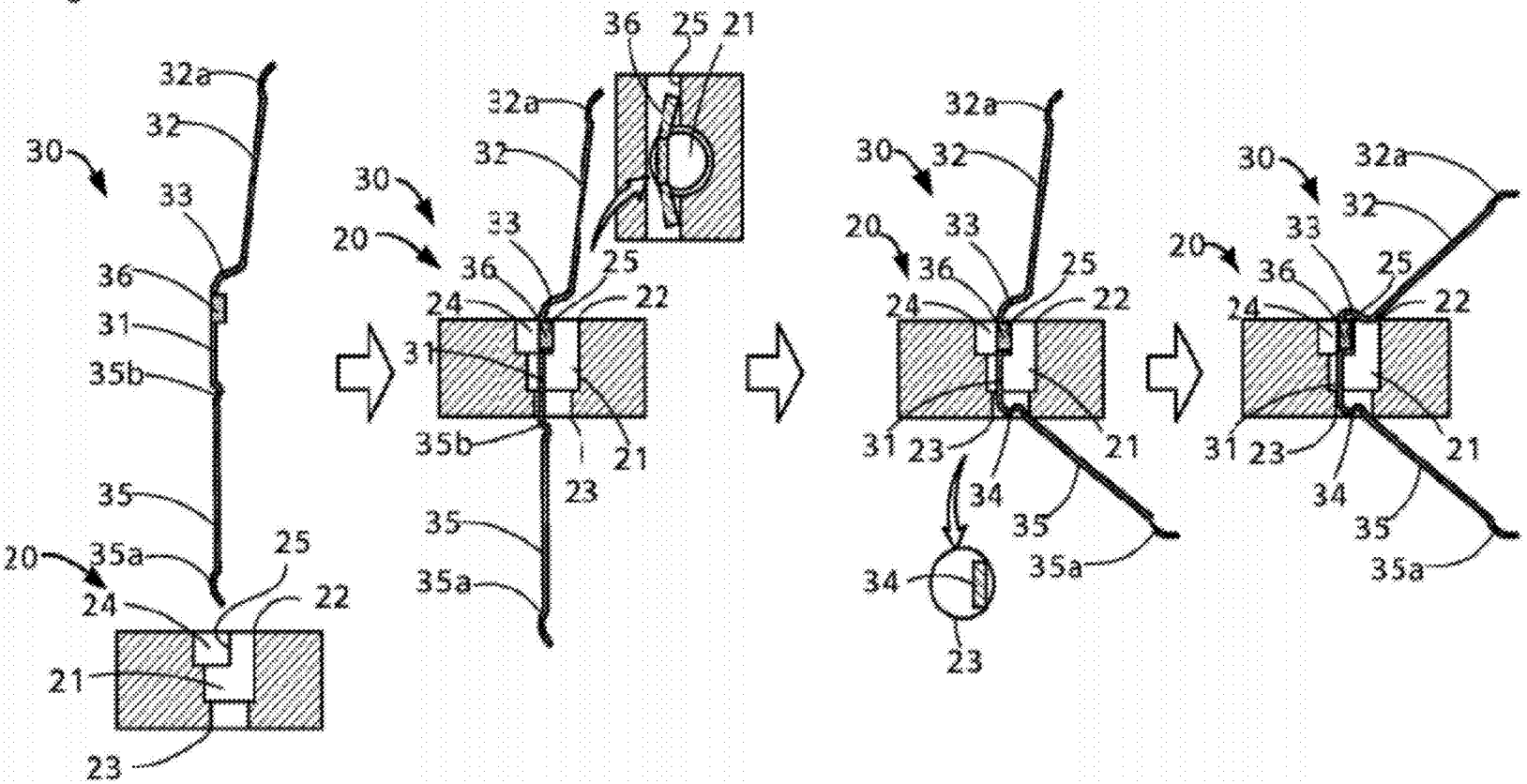
FIG. 5 is an explanatory diagram of respective processes of attaching the connector 30 to a carrier 20 to produce the electrical connection body 10.

Subsequently, a method of producing the electrical connection body 10 will be described. FIG. 5 is an explanatory diagram of respective processes of attaching the connector 30 to the carrier 20 to produce the electrical connection body 10. In the electrical connection body 10, a flat plate having the shape illustrated in the upper diagram in FIG. 4 is first processed. The flat plate is subjected to a folding and bending process to produce the connector 30 as illustrated in the lower diagram in FIG. 4. The connector 30 before being attached to the carrier 20 has the gently curved second contact 35*a* formed at a lower end tip thereof, and a folded portion 35*b* bent into a U-shape and formed in a portion of the second beam 35 provided to the connecting portion 31. The connecting portion 31 and the second beam 35 are overall formed into a substantially flat plate shape. Then, the carrier 20 is formed with the through-hole 21, and then with the groove portion 24. In this process, a through-hole is drilled, and thereafter a hole having an outer diameter larger than the outer diameter of the drilled through-hole is formed to an intermediate position at which the hole does not pierce through the carrier 20. Thereby, the first opening portion 22 larger in opening diameter than the second opening portion 23 is formed. Then, the groove portion 24 is formed at a position at which the regulating portions 36 can press the wall portion 25 when the connecting portion 31 is inserted in the through-hole 21. In this case, the positional accuracy of the connecter 30 in the forming direction of the through-hole 21 can be adjusted by the folded portion 33 and the S-shaped portion 34 of the connector 30. Therefore, the processing accuracy in the depth direction of the groove portion 24 can be relatively low. The thus formed connector 30 is inserted into the carrier 20 (see the first diagram from the left side in FIG. 5). In this process, the tip of the second beam 35 not formed with the regulating portions 36 is inserted into the first opening portion 22 having the large opening diameter. Thereby, the connecting portion 31 is disposed in the through-hole 21, and the regulating portions 36 come into contact with the wall portion 25 (the second diagram from the left side in FIG. 5). When the connector 30 is inserted to a fixing position, the second beam 35 is folded (the third diagram from the left side in FIG. 5). In this process, the folded portion 35*b* forms the S-shaped portion 34 entering the interior of the through-hole 21. Further, an end portion of the S-shaped portion 34 comes into contact with the second opening portion 23. Then, the first beam 32 is folded, and an end portion of the folded portion 33 comes into contact with the first opening portion 22. In this process, the regulating portions 36 press the wall portion 25, and the connecting portion 31 is biased in a direction separating from the wall portion 25 (the fourth diagram from the left side in FIG. 5). In the above-described manner, the regulating portions 36 come into contact with the wall portion 25 to regulate the axial rotation of the connector 30. Further, the first beam 32 and the second beam 35 are bent with respect to the connecting portion 31 and come into contact with the first opening portion 22 and the second opening portion 23 of the through-hole 21, respectively, to regulate the movement of the connector 30 in the forming direction of the through-hole 21. Thereby, the connector 30 is reliably fixed to the carrier 20.

According to the electrical connection body 10 of the present embodiment described above, the carrier 20 is formed with the through-holes 21 and the wall portion 25 formed upright by the groove portion 24 on both sides of each of the through-holes 21. Further, the connector 30 is provided with the first beam 32 on one end of the connecting portion 31 and the second beam 35 on the other end of the connecting portion 31, and is also provided with the regulating portions 36 on both sides of the connecting portion 31 on the side of the first beam 32. The regulating portions 36 come into contact with the wall portion 25 to regulate the axial rotation of the connector 30. Further, the first beam 32 and the second beam 35 are bent with respect to the connecting portion 31 and come into contact with the respective opening portions of the through-hole 21, to thereby regulate the movement of the connector 30 in the forming direction of the through-hole 21. In the above-described manner, the axial rotation of the connector 30 is more firmly regulated by the regulating portions 36 and the wall portion 25. Further, the beams of the connector 30 inserted in the through-hole 21 are bent to fix the connector 30. Therefore, the dimensional accuracy in the forming direction of the through-hole 21 is more mitigated. Further, due to the process of bending the beams, the connector 30 can be more easily fixed. Therefore, the connector 30 and the carrier 20 can be more reliably fixed to each other, and the electrical connection body 10 is more easily produced.

Further, with the formation of the groove portion 24, it is possible to form the wall portion 25 provided upright in the forming direction of the through-hole 21. Therefore, the wall portion 25 can be formed with relative ease. Further, the groove portion 24 is formed to overlap with a part of the through-hole 21. Therefore, the wall portion 25 is easily formed on both sides of the through-hole 21. Accordingly, the electrical connection body 10 is further easily produced.

Further, the regulating portions 36 come into contact with the wall portion 25 on both sides of the through-hole 21. Therefore, the axial rotation of the connector 30 can be more reliably suppressed. Further, the regulating portions 36 are provided to be inclined from the connecting portion 31 toward the wall portion 25. Therefore, it is easier for the regulating portions 36 to press the wall portion 25, and thus the axial rotation of the connector 30 can be further reliably suppressed. Furthermore, the side of the second beam 35 provided with the connecting portion 31 forms the S-shaped portion 34 bent into an S-shape, and the S-shaped portion 34 is in contact with the second opening portion 23 with at least a part of the S-shaped portion 34 located in the interior of the through-hole 21. For example, therefore, the influence of the springback of the beam can be more suppressed, and the connector 30 and the carrier 20 can be further reliably fixed to each other. Further, the first opening portion 22, into which the tip of the second beam 35 is inserted, is larger in opening diameter than the second opening portion 23. Therefore, the connector 30 is more easily inserted into the through-hole 21, and the electrical connection body 10 is further easily produced. Further, the second beam 35 inserted in the second opening portion 23 having the small opening diameter is bent to come into contact with the second opening portion 23. Therefore, the connector 30 and the carrier 20 are easily fixed to each other. Furthermore, the opening diameter of the through-hole 21 is formed in a plurality of stages. Therefore, the through-hole 21 having different opening diameters can be more easily formed. Moreover, the connector 30 can be formed by a relatively simple folding and bending process, and can be fixed to the carrier 20 by a relatively simple folding and bending process. Therefore, it is unnecessary to form a constricted portion for reducing the springback, and the connector 30 is more easily processed. Accordingly, the yield of the connector 30 can be improved. Still further, the folded portion 33 and the S-shaped portion 34 regulate the movement of the connector 30 in the forming direction of the through-hole 21. Therefore, the processing accuracy of the connector 30 and the carrier 20 in the depth direction of the wall portion 25 is less required, and thus the connector 30 and the carrier 20 are easily produced. Further, the connecting portion 31, the first beam 32, the second beam 35, and the regulating portions 36 are integrally formed. Therefore, the connector 30 is easily produced.

Figure 6:
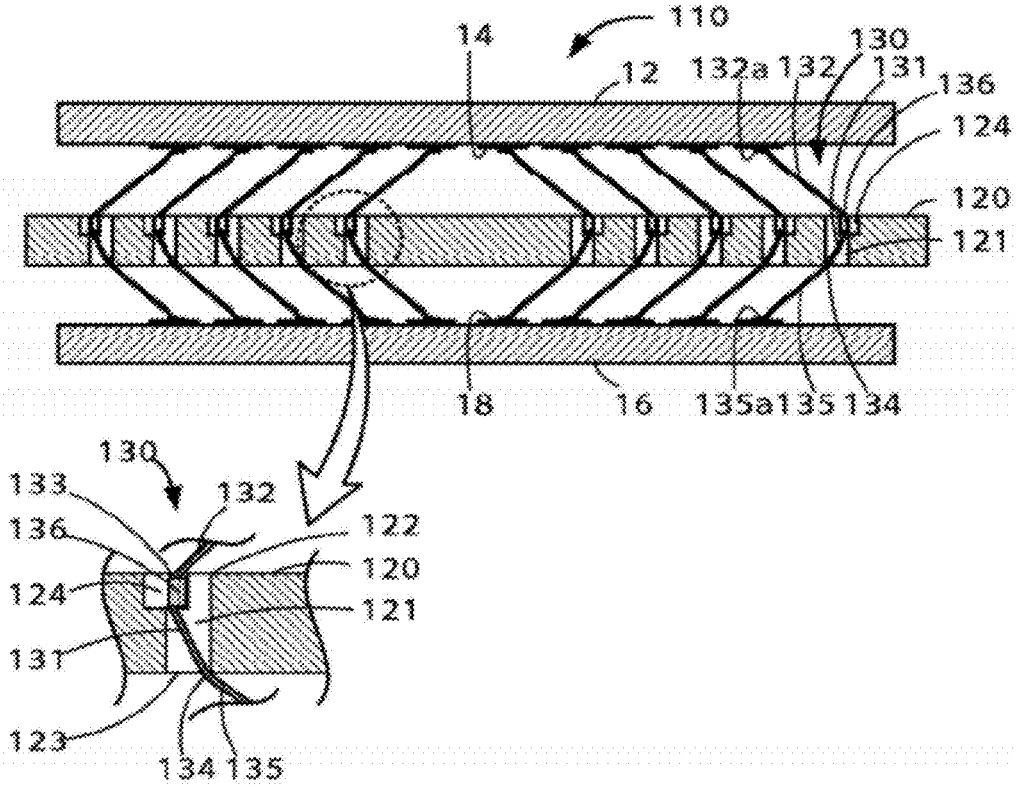
FIG. 6 is a cross-sectional view illustrating an overview of the structure of an electrical connection body 110, which is another embodiment.
Figure 7:
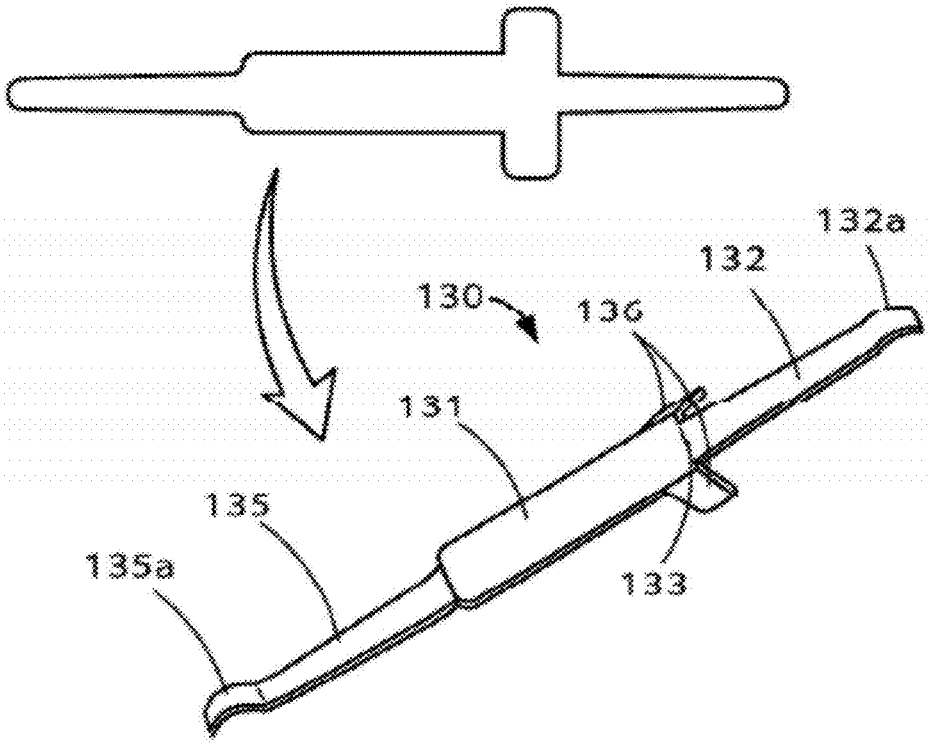
FIG. 7 is an explanatory diagram of a connector 130 included in the electrical connection body 110.
Figure 8:
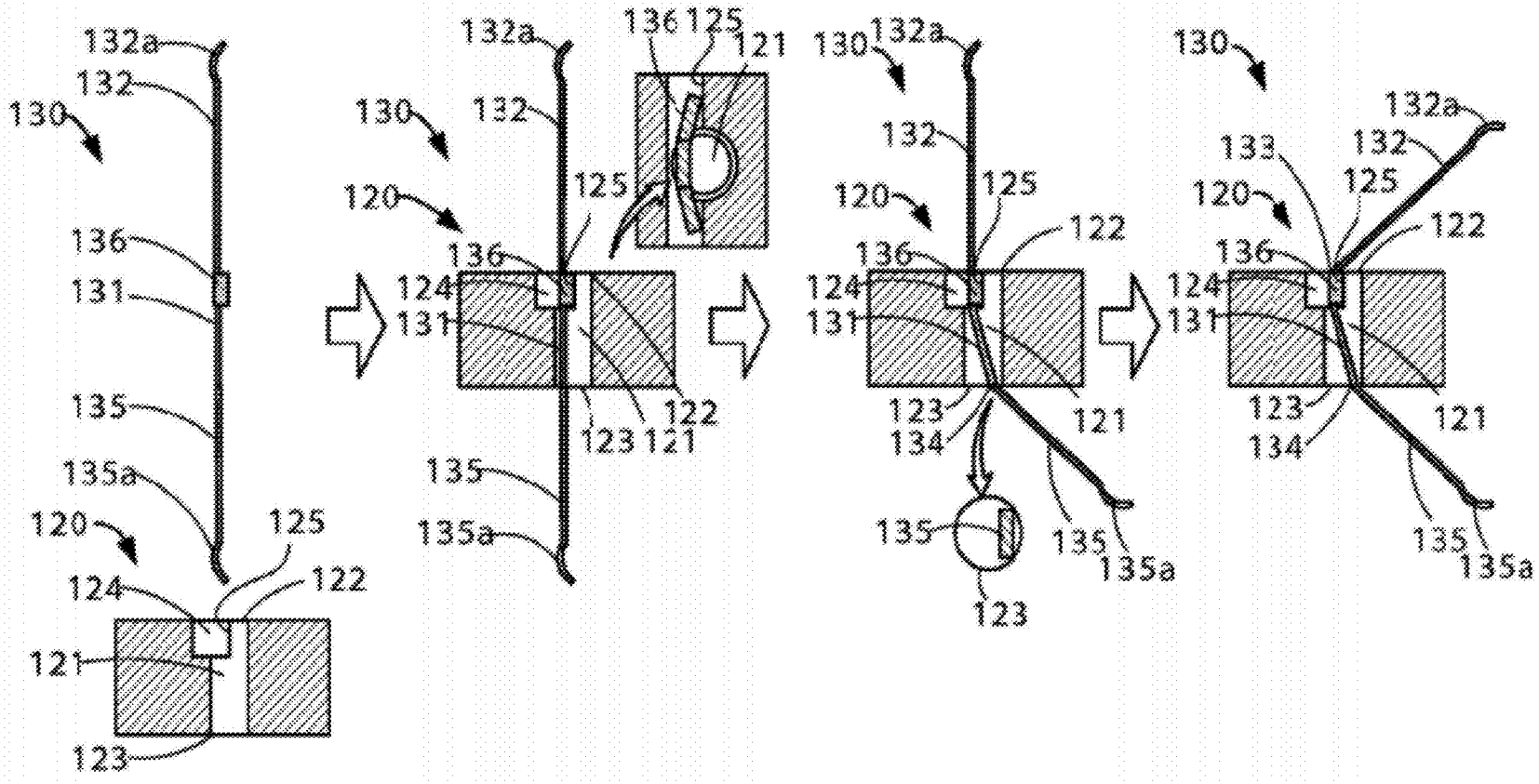
FIG. 8 is an explanatory diagram of respective processes of attaching the connector 130 to a carrier 120 to produce the electrical connection body 110.

In the above-described first embodiment, the folded portion 35*b* is provided to form the S-shaped portion 34 for regulating the movement of the connector 30. However, as illustrated in FIGS. 6 to 8, for example, the folded portion 35*b* may not be provided to omit the formation of the S-shaped portion 34, and a bent portion 134 may be provided to regulate the movement of the connector 30. FIG. 6 is a cross-sectional view illustrating an overview of the structure of an electrical connection body 110, which is another embodiment. FIG. 7 is an explanatory diagram of a connector 130 included in the electrical connection body 110. FIG. 8 is an explanatory diagram of respective processes of attaching the connector 130 to a carrier 120 to produce the electrical connection body 110. In the following description, the same configurations as the configurations of the above-described first embodiment will be assigned with the same reference numerals, and description thereof will be omitted. Herein, description will be made with reference to a through-hole 121 having a constant opening diameter. That is, the through-hole 21, which has different opening diameters in the above-described first embodiment, may be formed to have the same opening diameter. As illustrated in FIG. 6, the electrical connection body 110 includes the carrier 120 and the connectors 130 each having the bent portion 134 not formed into an S-shape. Similarly to the above-described first embodiment, in the electrical connection body 110, regulating portions 136 come into contact with a wall portion 125 to regulate the axial rotation of the connector 130, and the bent portion 134 and a second opening portion 123 come into contact with each other to regulate the upward movement of the connector 130. Further, the regulating portions 136 come into contact with the bottom surface of a groove portion 124, or a folded portion 133 comes into contact with a first opening portion 122, to thereby regulate the downward movement of the connector 130.

A method of producing the electrical connection body 110 will be described with reference to FIG. 8. In the electrical connection body 110, a flat plate having the shape illustrated in the upper diagram in FIG. 7 is first processed. The flat plate is subjected to a folding and bending process to produce the connector 130 as illustrated in the lower diagram in FIG. 7. The connector 130 before being attached to the carrier 120 has a gently curved first contact 132*a* formed at an upper end tip thereof, and a gently curved second contact 135*a* formed at a lower end tip thereof. A connecting portion 131 and a second beam 135 are formed into a substantially flat plate shape. The groove portion 124 is formed in the carrier 120 to overlap with a part of the first opening portion 122 of the through-hole 121. In this case, the positional accuracy of the connecter 130 in the forming direction of the through-hole 121 can be adjusted by the bent portion 134 of the connector 130 and so forth. Therefore, the processing accuracy in the depth direction of the groove portion 124 can be relatively low. The thus formed connector 130 is inserted into the carrier 120 (see the first diagram from the left side in FIG. 8) to dispose the connecting portion 131 in the interior of the through-hole 121 and bring the regulating portions 136 into contact with the wall portion 125 (the second diagram from the left side in FIG. 8). When the connector 130 is inserted to a fixing position, the second beam 135 is folded (the third diagram from the left side in FIG. 8). In this process, an end portion of the bent portion 134 comes into contact with the second opening portion 123. Then, the first beam 132 is folded, and lower end portions of the regulating portions 136 come into contact with the bottom surface of the groove portion 124. In this process, the regulating portions 136 press the wall portion 125, and the connecting portion 131 is biased in a direction separating from the wall portion 125 (the fourth diagram from the left side in FIG. 8). In the above-described manner, the regulating portions 136 come into contact with the wall portion 125 to regulate the axial rotation of the connector 130. Further, the regulating portions 136 come into contact with the bottom surface of the groove portion 124, and the second beam 135 is bent with respect to the connecting portion 131 and comes into contact with the second opening portion 123 of the through-hole 121, to thereby regulate the movement of the connector 130 in the forming direction of the through-hole 121. Therefore, the connector 130 is reliably fixed to the carrier 120. As described above, the connector 130 and the carrier 120 can be more reliably fixed to each other, and the electrical connection body 110 is more easily produced. Further, as illustrated in FIG. 7, in the connector 130, the second beam 135 and the connecting portion 131 before being inserted into the through-hole 121 are formed into a flat plate shape. Therefore, the connector 130 is more easily inserted into the through-hole 121, and the electrical connection body 110 is further easily produced.

Further, in the above-described first embodiment, the through-hole 21 is formed to have the two staged diameters to make the first opening portion 22 larger in opening diameter than the second opening portion 23. However, the configuration is not particularly limited thereto, as long as the first opening portion 22 and the second opening portion 23 have different sizes. For example, the through-hole 21 may be formed to have three or more staged diameters, and the through-hole 21 may be formed into a tapered shape.

Figure 9:
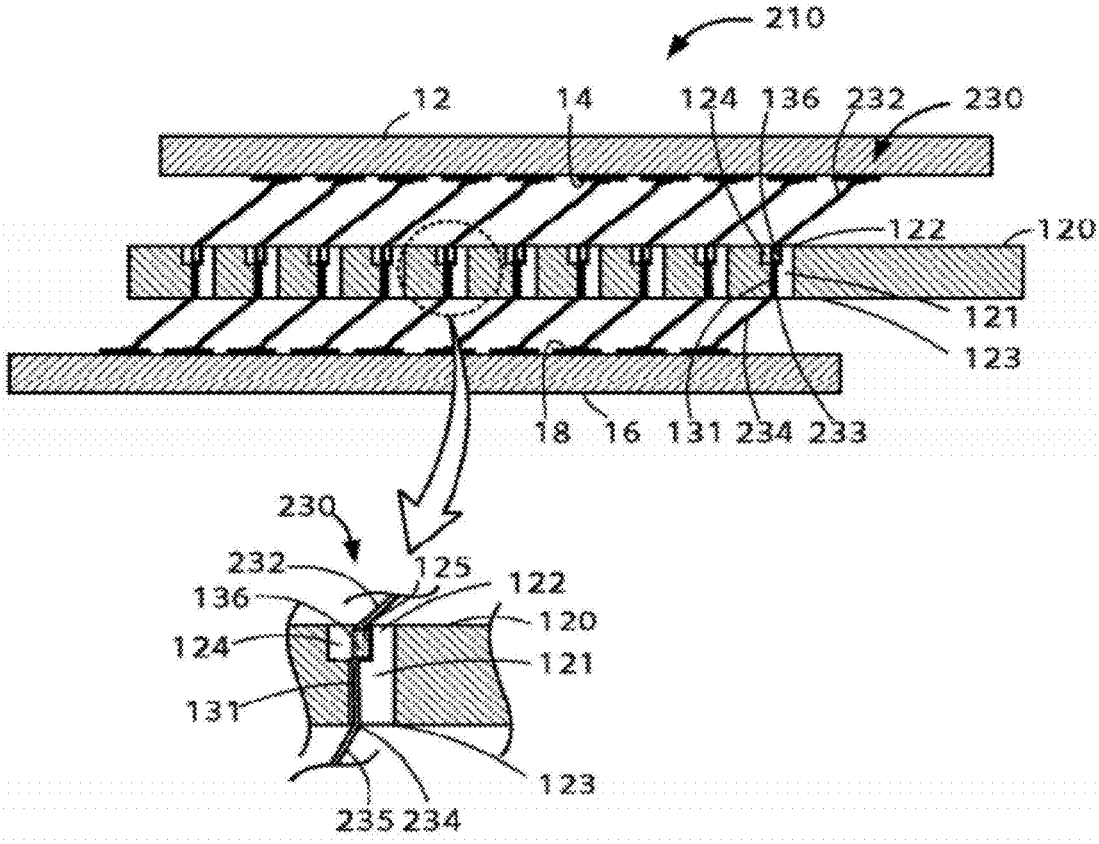
FIG. 9 is a cross-sectional view illustrating an overview of the structure of an electrical connection body 210.

In the above-described first embodiment, the electrical connection body 10 includes the connectors 30, in each of which the first beam 32 and the second beam 35 are folded in the same direction. However, the configuration is not particularly limited thereto. As illustrated in FIG. 9, an electrical connection body 210 may be configured to include connectors 230, in each of which a first beam 232 and a second beam 235 are folded in different directions. This configuration is also capable of suppressing the rotation of the connector 230 due to the contact between the regulating portions 136 and the wall portion 125, and regulating the upward movement of the connector 230 due to the contact between the second beam 235 and the second opening portion 123. Accordingly, the connector 230 and the carrier 120 can be more reliably fixed to each other, and the electrical connection body 210 is more easily produced.

Figure 10:
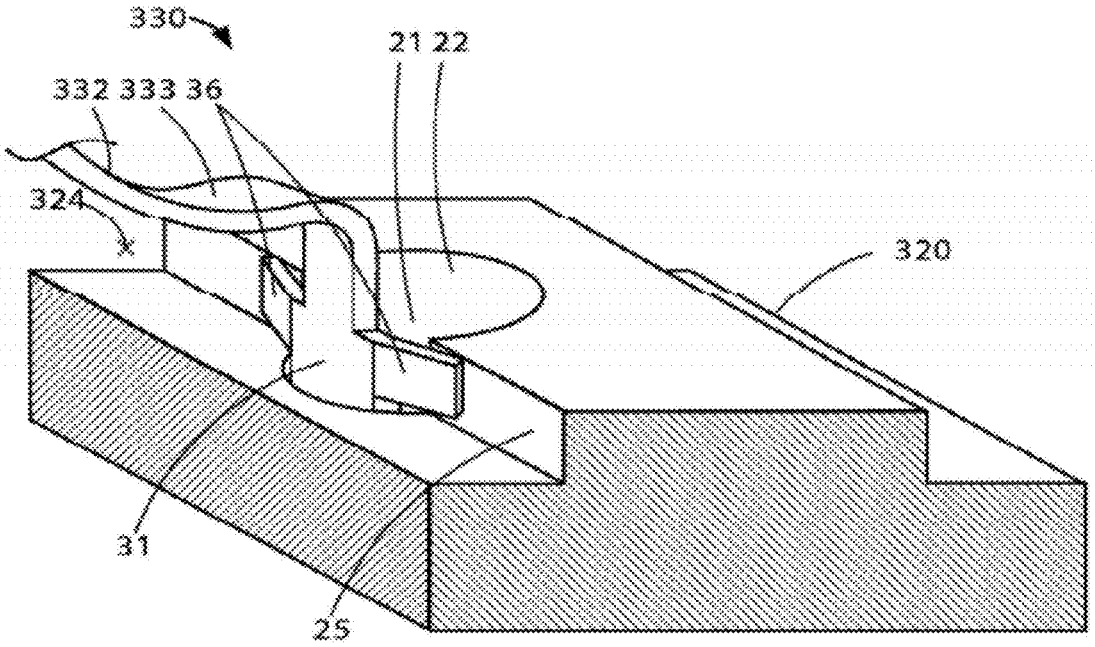
FIG. 10 is an explanatory diagram of a carrier 320 and a connector 330 according to another embodiment.

In the above-described first embodiment, the connector 30 is configured such that the regulating portions 36 are provided to be inclined with respect to the connecting portion 31 toward the wall portion 25 in the folding direction of the first beam 32, and that the first beam 32 is folded in the same direction as the inclination direction. However, the configuration is not particularly limited thereto. For example, as illustrated in FIG. 10, a connector 330 may be configured such that a first beam 332 is folded at a folded portion 333 in a direction different from the inclination direction of the regulating portions 36. FIG. 10 is an explanatory diagram of a carrier 320 and the connector 330 according to another embodiment. This configuration is also capable of more reliably fixing the connector 330 and the carrier 320 to each other, and makes the production of the electrical connection body easier.

In the above-described first embodiment, the carrier 20 is configured such that the groove portion 24 is formed to provide the wall portion 25 upright in the forming direction of the through-hole 21. However, the configuration is not particularly limited thereto, as long as the wall portion 25 is provided upright in the forming direction of the through-hole 21. For example, as illustrated in FIG. 10, the wall portion 25 may be formed by a raised convex portion overlapping with a part of the through-hole 21. This configuration is also capable of suppressing the rotation of the connector 330 in the axial direction due to the contact between the wall portion 25 and the regulating portions 36.

Figure 11:
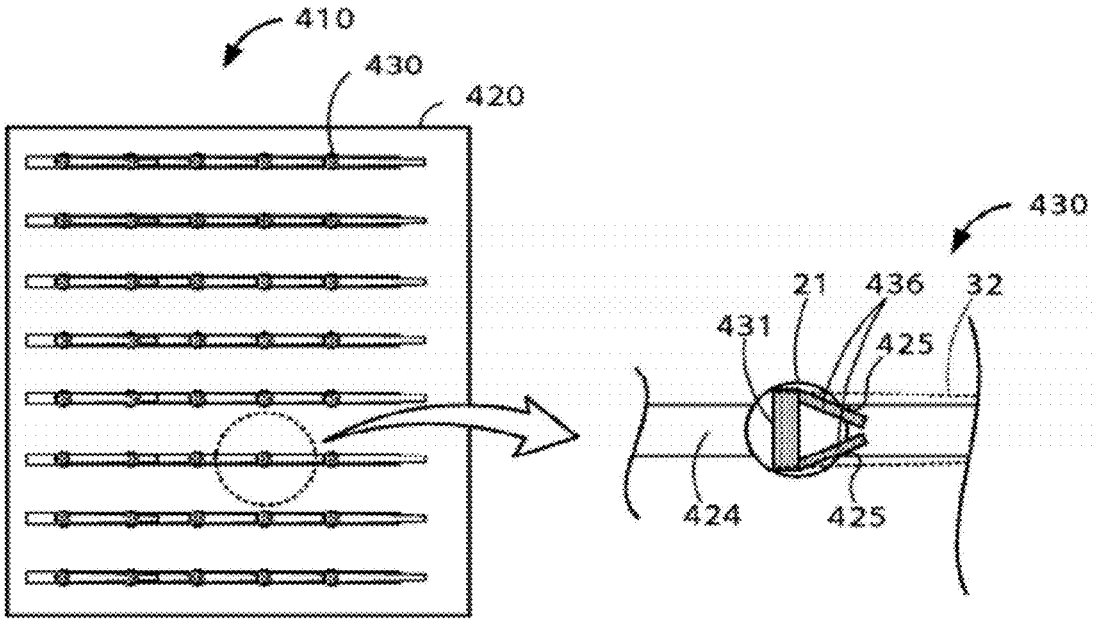
FIG. 11 is an explanatory diagram of an electrical connection body 410 according to another embodiment.
Figure 12:
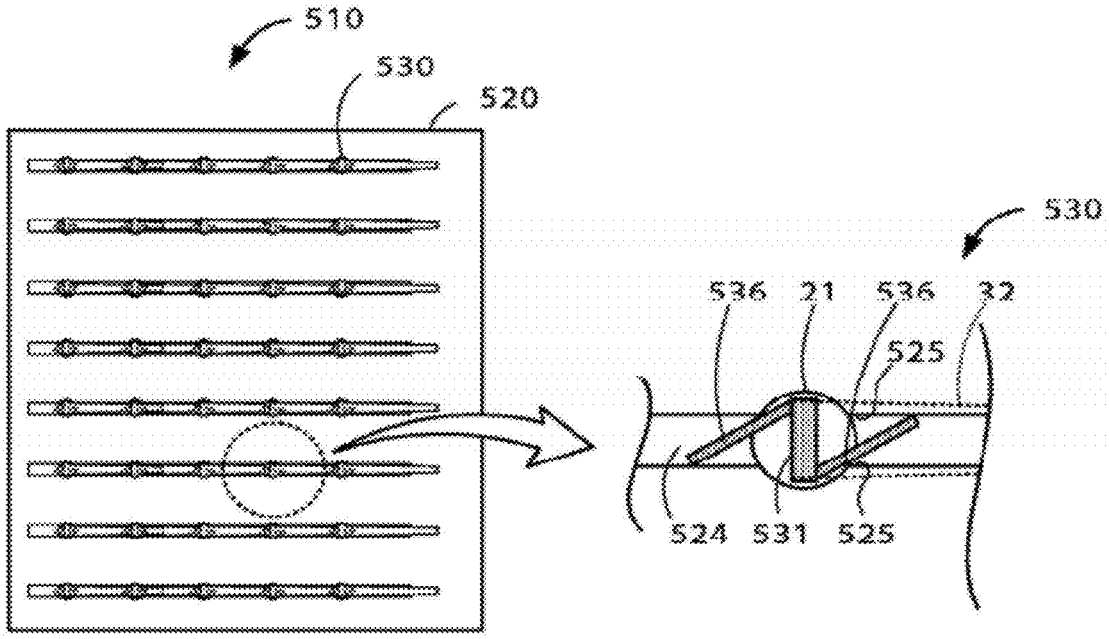
FIG. 12 is an explanatory diagram of an electrical connection body 510 according to another embodiment.

In the above-described first embodiment, the electrical connection body 10 is configured such that the groove portion 24 is provided to be perpendicular to the direction in which the first beam 32 is oriented, and that the regulating portions 36 are provided to come into contact with the wall portion 25 of the groove portion 24. However, an electrical connection body 410 as illustrated in FIG. 11 or an electrical connection body 510 as illustrated in FIG. 12 may be configured. The electrical connection body 410 illustrated in FIG. 11 includes a carrier 420, in which groove portions 424 are provided to extend in the same direction as the direction in which the first beam 32 is oriented such that each of the groove portions 424 crosses the center of the through-hole 21 while overlapping with a part of the through-hole 21, and connectors 430, in each of which regulating portions 436 are provided to extend from both sides of a connecting portion 431 in the forming direction of the groove portion 424 and are respectively in contact with wall portions 425 and 425 provided upright by the groove portion 424. In the connector 430, the regulating portions 436 are provided on both the left and right sides of the connecting portion 431 to extend in the same direction. This configuration is also capable of regulating the axial rotation of the connector 430 due to the contact of the regulating portions 436 with the wall portions 425, and more reliably fixing the connector 430 and the carrier 420 to each other, and makes the production of the electrical connection body 410 easier. Alternatively, the electrical connection body 510 illustrated in FIG. 12 includes a carrier 520, in which groove portions 524 are provided to extend in the same direction as the direction in which the first beam 32 is oriented such that each of the groove portions 524 crosses the center of the through-hole 21 while overlapping with a part of the through-hole 21, and connectors 530, in each of which regulating portions 536 are provided to extend from both sides of a connecting portion 531 in the forming direction of the groove portion 524 and are respectively in contact with wall portions 525 and 525 provided upright by the groove portion 524. In the connector 530, the regulating portions 536 on both the left and right sides of the connecting portion 531 are provided to extend in different directions from each other. This configuration is also capable of regulating the axial rotation of the connector 530 due to the contact of the regulating portions 536 with the wall portions 525, and more reliably fixing the connector 530 and the carrier 520 to each other, and makes the production of the electrical connection body 510 easier.

In the above-described first embodiment, the connector 30 is configured such that the connecting portion 31, the first beam 32, the second beam 35, and the regulating portions 36 are integrally formed. However, the configuration is not particularly limited thereto. Thus, two or more members may be connected together. In this case, the first beam 32 and the second beam 35 may be formed as separate members, and the regulating portions 36 may be formed as separate members.

In the above-described first embodiment, the regulating portions 36 are provided to be inclined from the connecting portion 31 toward the wall portion 25 of the groove portion 24. However, the configuration is not particularly limited thereto, as long as the regulating portions 36 come into contact with the wall portion 25 to fix the connector 30. Thus, the regulating portions 36 may be formed as flat plate-like regulating portions having no inclination, or regulating portions 36 provided to be inclined from the wall portion 25 toward the connecting portion 31. The configuration in which the regulating portions 36 are provided to be inclined from the connecting portion 31 toward the wall portion 25 of the groove portion 24 is more preferable in terms of the fixedness of the connector 30. Further, the regulating portions 36 are formed into a flat plate shape. However, the regulating portions 36 may be formed into another shape, e.g., a rod shape. Further, the regulating portions 36 are formed on both sides (ends portions on the left and right sides) of the connecting portion 31. However, the configuration is not particularly limited thereto. Thus, the regulating portions 36 may be formed on a portion other than the both sides of the connecting portion 31. Further, the number of the formed regulating portions 36 is two for each connector 30. However, the number can be any number, as long as the number is one or more.

Figure 13:
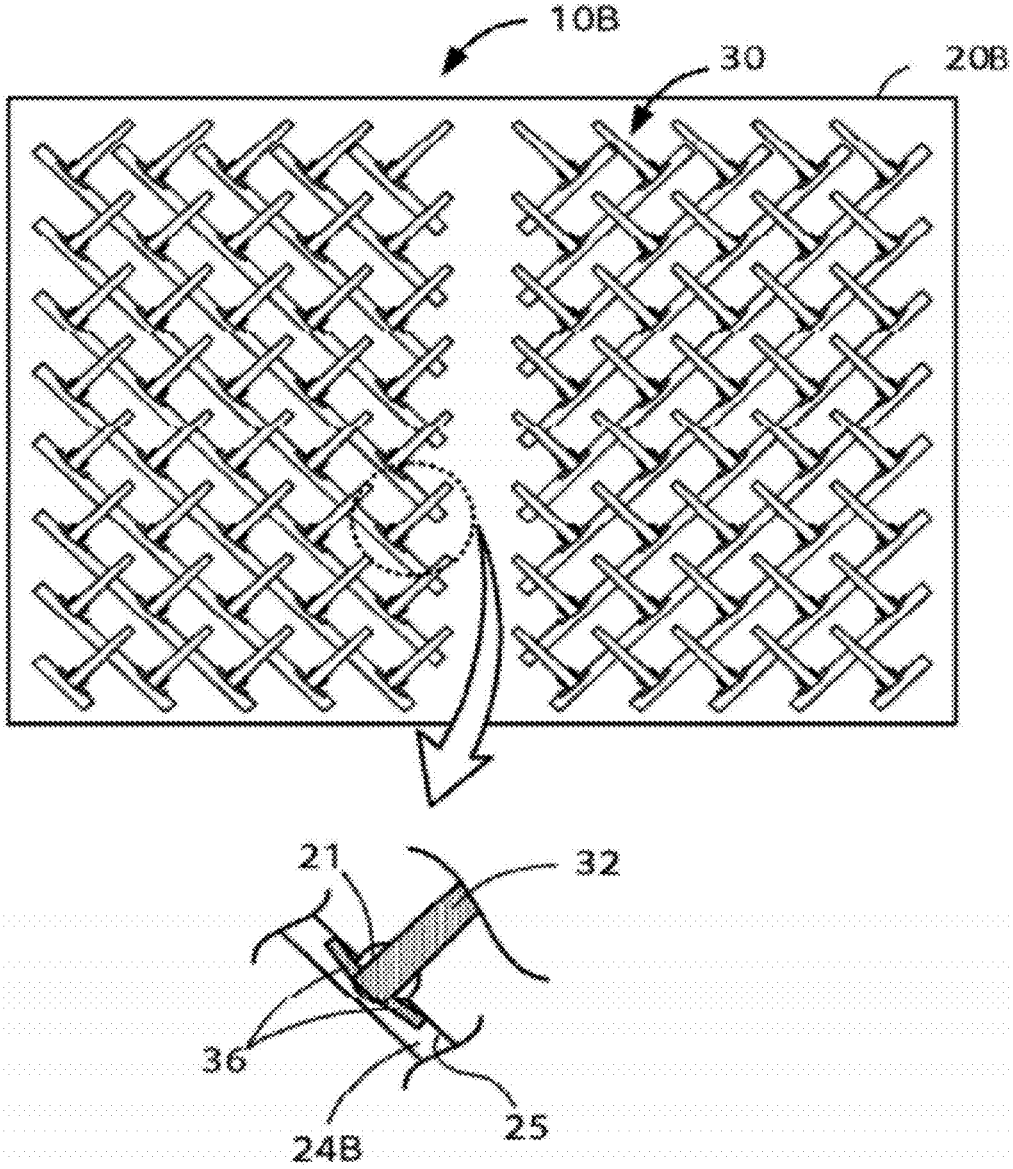
FIG. 13 is an explanatory diagram of an electrical connection body 10B according to another embodiment.

In the above-described first embodiment, the carrier 20 is configured such that the through-holes 21 are formed in a grid pattern and the groove portions 24 are provided along the sides of the grid. However, as illustrated in FIG. 13, an electrical connection body 10B may be configured to include a carrier 20B provided with groove portions 24B arranged not along the sides of the grid of the through-holes 21. FIG. 13 is an explanatory diagram of the electrical connection body 10B according to another embodiment. In the electrical connection body 10B, the groove portions 24B are formed along diagonal lines of the grid of the through-holes 21. Further, in the electrical connection body 10B, the first beam 32 and the second beam 35 of the connector 30 are provided in a direction perpendicular to the wall portion 25 of the groove portion 24B. With this configuration, the overlapping of the beams of the respective connectors 30 can be suppressed. For example, therefore, the connectors 30 are more easily replaced when damaged.

The above-described first embodiment includes the connector 30 in which at least one of the first beam 32 and the second beam 35 is bent with respect to the connecting portion 31 and comes into contact with an opening portion of the through-hole 21, to thereby regulate the movement in the forming direction of the through-hole 21. However, the configuration is not particularly limited thereto. Thus, the first beam 32 or the second beam 35 may not come into contact with an opening portion of the through-hole 21. This configuration is also capable of regulating the movement of the connector 30 due to the contact of the regulating portions 36 with the wall portion 25. In this case, the configuration may be such that the regulating portions 36 press the wall portion 25 to regulate the movement of the connector 30 in the forming direction of the through-hole 21. The configuration in which the first beam 32 or the second beam 35 comes into contact with an opening portion of the through-hole 21 is more preferable in terms of the suppression of the movement of the connector 30.

The above-described first embodiment is configured such that the gently curved first contact 32*a* and second contact 35*a* connect the first device 12 and the second device 16. However, as the contact of at least one of the first beam 32 and the second beam 35, preferably either one thereof, a solder ball may be provided. If the solder ball is provided as the contact, it is preferable that the tip portion of the first or second beam is provided with a land portion for fixing the solder ball. If the land portion is provided, the beam provided with the land portion does not necessarily have to have the same length as the length of the original beam, and the land portion may be adjacent to a bent portion (a base portion of the beam).

Although not described in the above-described first embodiment, a bonding layer may be provided between the connector 30 and the carrier 20. In the electrical connection body 10 of the present invention, the regulating portions 36 and the wall portion 25 come into contact with each other, and thus the rotation of the connector 30 can be suppressed. Therefore, the bonding layer may not be provided.

Second Embodiment

Figure 14:
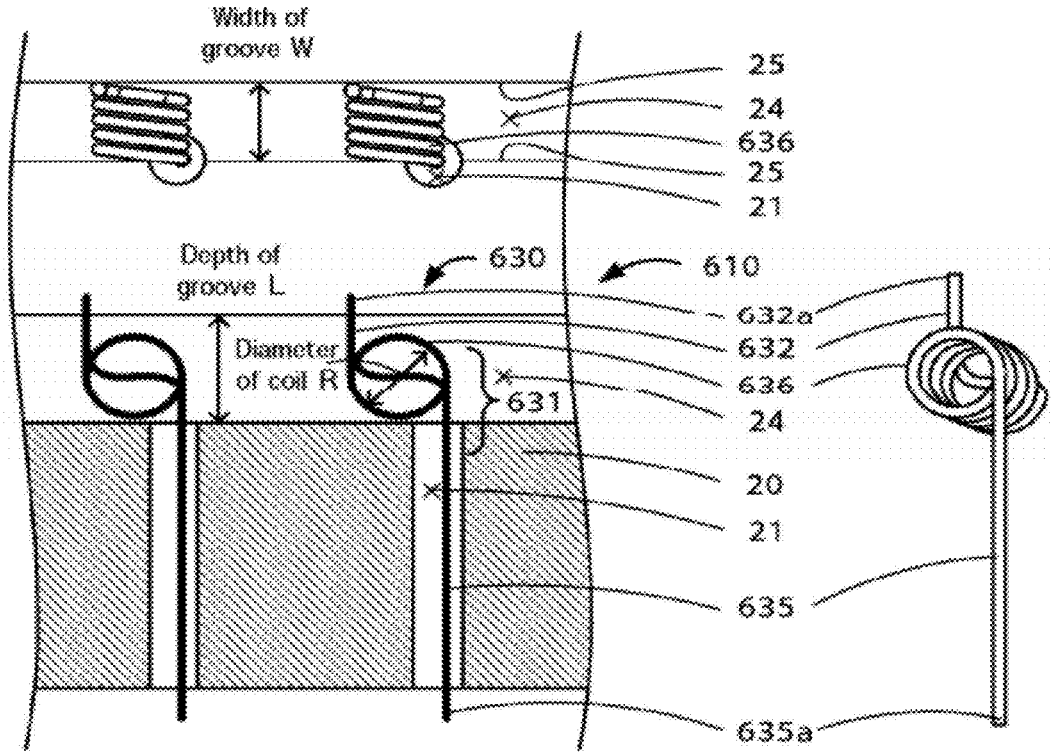
FIG. 14 is a cross-sectional view illustrating an overview of the structure of an electrical connection body 610.
Figure 15:
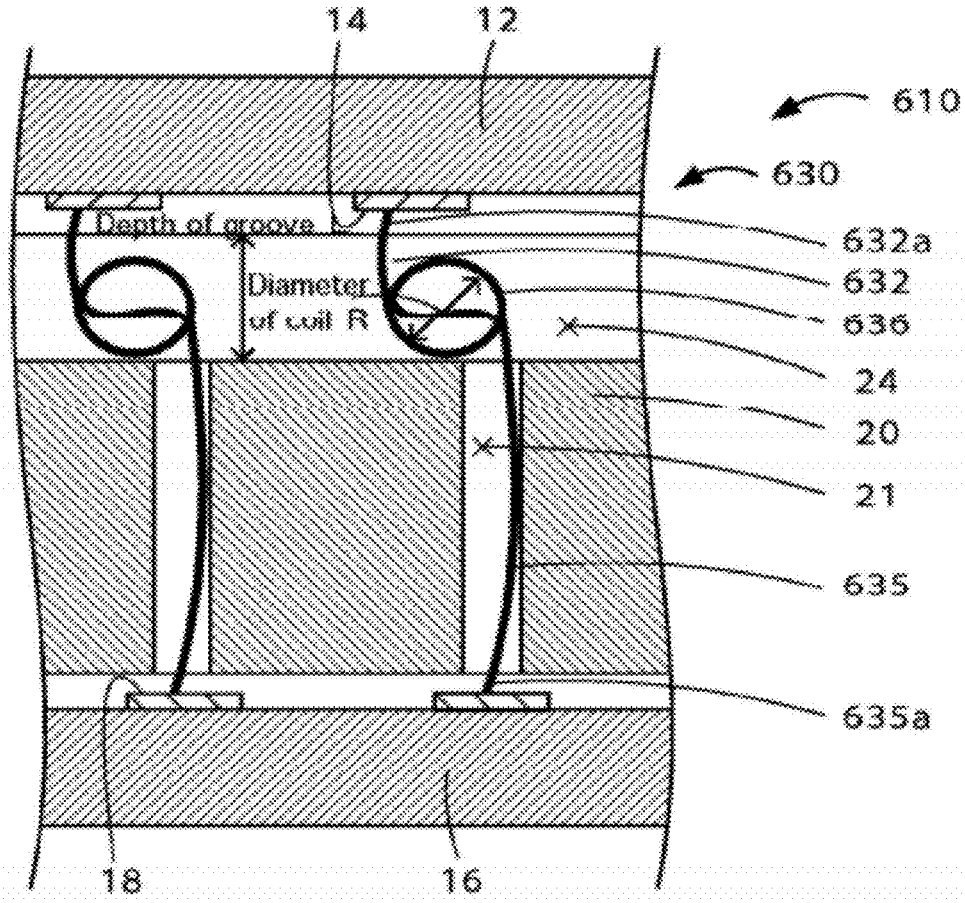
FIG. 15 is a cross-sectional view illustrating the overview of the structure of the electrical connection body 610.

Subsequently, a second embodiment for implementing the present invention will be described with reference to the drawings. FIGS. 14 and 15 are cross-sectional views illustrating an overview of the structure of an electrical connection body 610, which is an embodiment of the present invention. FIG. 14 illustrates a plan view of the electrical connection body 610 and an explanatory diagram of a connector 630. The configurations similar to the configurations of the above-described embodiment will be assigned with the same reference numerals, and description thereof will be omitted. As illustrated in FIGS. 14 and 15, the electrical connection body 610 includes the carrier 20 and the connectors 630. Each of the connectors 630 includes a first beam 632 having a first contact 632*a* connected to one of facing electrodes, a second beam 635 having a second contact 635*a* connected to the other one of the facing electrodes, a connecting portion 631 provided with the first beam 632 and the second beam 635, and a regulating portion 636 which comes into contact with the wall portions 25 and 25 of the carrier 20 to regulate the movement. In the electrical connection body 610, the connecting portion 631 is inserted in the through-hole 21, with the first beam 632 and the second beam 635 projecting from different surfaces of the carrier 20. Further, the connector 630 has the linear shaped first beam 632 and the linear shaped second beam 635 projecting from the different surfaces of the carrier 20, and the respective tips of the beams form the first contact 632*a* and the second contact 635*a*.

In the connector 630, a single wire rod is processed to form the first beam 632, the second beam 635, the connecting portion 631, and the regulating portion 636. Therefore, the cross section of the first beam 632 and the second beam 635 is formed by a circular rod-like body, and the connecting portion 631 refers to a region connecting the first beam 632 and the second beam 635. As the material forming the connector 630, a highly conductive material is preferable. For example, it is preferable that the connector 630 mainly includes the conductive material equivalent to the first embodiment. The diameter of the wire rod forming the connector 630 is preferably 0.015 mm or more and 0.3 mm or less, and more preferably in a range of 0.08 mm or more and 0.2 mm or less. If the diameter of the wire rod is 0.015 mm or more, the shape stability can be improved. If the diameter of the wire rod is 0.2 mm or less, the arrangement interval of the connectors 630 can be reduced. Further, in the connector 630, the first beam 632 is formed in a direction different from the winding direction from the second beam 635. That is, in the connector 630, the second beam 635 is formed to extend downward at one end of a coil forming the regulating portion 636, and the first beam 632 is formed to extend upward at the other end located diagonally from the one end.

The regulating portion 636 is formed as a coil for applying spring force to the wall portions 25 and 25 provided upright to the carrier 20. That is, the connector 630 is provided in the groove portion 24, and a single wire rod is wound to form the coil-like regulating portion 636. Further, the connector 630 is produced to have one end formed as the first beam 632 and the other end formed as the second beam 635. Further, the regulating portion 636 comes into contact with the wall portions 25 and 25 to regulate the axial rotation of the connector 630, and to regulate the movement of the connector 630 in the forming direction of the through-hole 21. The number of turns of the coil forming the regulating portion 636 can be any number, as long as the coil having the number of turns has spring force capable of regulating the movement of the connector 630. For example, the number of turns may be two or more and six or less. The number of turns of the coil may also be set to be a number which allows the coil to be inserted in the groove portion 24, in accordance with the width of the groove portion 24 and the diameter of the wire rod forming the connector 630. The width of the groove portion 24 is determined on the basis of the arrangement interval and the processing accuracy of the connectors 630. Further, it is preferable that the diameter R of the coil forming the regulating portion 636 is, for example, equal to or less than the groove depth L of the groove portion 24. Further, to prevent the connector 630 from coming off, it is preferable that the diameter R is approximately two-thirds of the groove depth L.

As illustrated in FIG. 15, the thus formed electrical connection body 610 is disposed between the first device 12 and the second device 16, and the first beam 632 and the second beam 635 connect with the first device 12 and the second device 16, respectively, to thereby electrically connect the first electrode 14 of the first device 12 and the second electrode 18 of the second device 16. When the electrical connection body 610 restrains the first device 12 and the second device 16, the first beam 632 and the second beam 635 are bent to establish electrical connection between the first contact 632*a* and the first electrode 14 and between the second contact 635*a* and the second electrode 18.

In the above-described electrical connection body 610, the coil forming the regulating portion 636 presses the wall portions 25 and 25 with the spring force thereof. Thereby, the axial rotation of the connector 630 is more firmly regulated, and the movement of the connector 630 in the forming direction of the through-hole 21 is also regulated. Further, the coil-like regulating portion 636 fixes the connector 630. Therefore, the dimensional accuracy in the forming direction of the through-hole 21 is more mitigated. Further, due to the winding process of the coil, the connector 630 can be more easily fixed. As described above, the connector 630 and the carrier 20 can be more reliably fixed to each other by the use of the spring force of the coil-like regulating portion 636. Further, with the coil-like regulating portion 636, the connector 630 can be produced by the winding process of a wire rod. Therefore, the connector 630 and the carrier 20 can be more reliably fixed to each other, and the electrical connection body 610 is more easily produced. Further, in the connector 630, a single wire rod forms the first beam 632, the second beam 635, the connecting portion 631, and the regulating portion 636. Therefore, the connector 630 is further easily produced. Further, in the production of the connector 630, the generation of waste material can be more suppressed. Further, the first beam 632 and the second beam 635 are formed into a linear shape. Thus, the connector 630 is more easily inserted into and removed from the through-hole 21. For example, therefore, individual replacement of the connectors 630 when damaged is considerably easy. Furthermore, the connector 630 can be formed by a relatively simple winding process, and can be fixed to the carrier 20 by relatively simple spring force. Therefore, it is unnecessary to form a constrained portion for reducing the springback, and the connector 630 is more easily processed. Accordingly, the yield of the connector 630 can be improved. Further, the connector 630 may be plated to improve the conductivity thereof. The connector 630 uses a wire rod, and thus is easily plated. Furthermore, with the formation of the groove portion 24, it is possible to form the wall portion 25 provided upright in the forming direction of the through-hole 21. Therefore, the wall portion 25 can be formed with relative ease. Further, the groove portion 24 is formed to overlap with a part of the through-hole 21. Therefore, the wall portion 25 is easily formed in the vicinity of the through-hole 21. Accordingly, the electrical connection body 610 is further easily produced.

Figure 16:
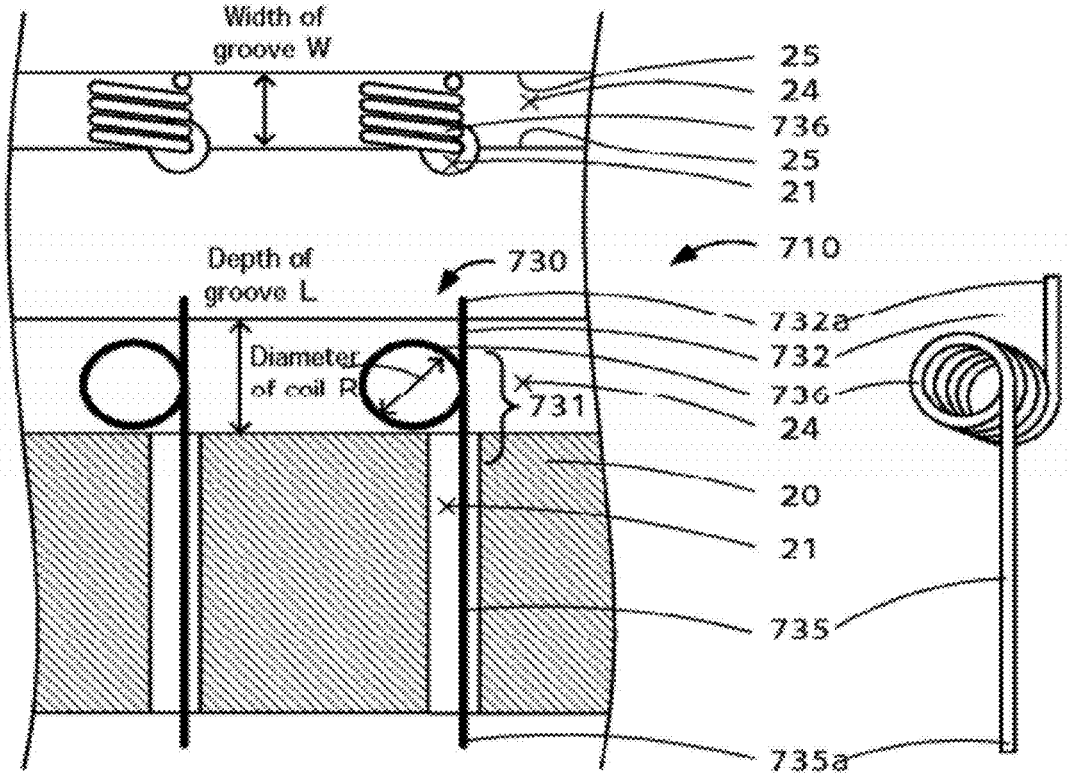
FIG. 16 is a cross-sectional view illustrating an overview of the structure of an electrical connection body 710.

In the above-described second embodiment, the first beam 632 is formed in a direction different from the winding direction from the second beam 635. However, as illustrated in FIG. 16, a connector 730 may be configured to include a regulating portion 736 formed with a first beam 732 in the same direction as the winding direction from a second beam 735. FIG. 16 is a cross-sectional view illustrating an overview of the structure of an electrical connection body 710. This configuration is also capable of more reliably fixing the connector 730 and the carrier 20 to each other, and providing an electrical connection body which is easier to produce.

Figure 17:
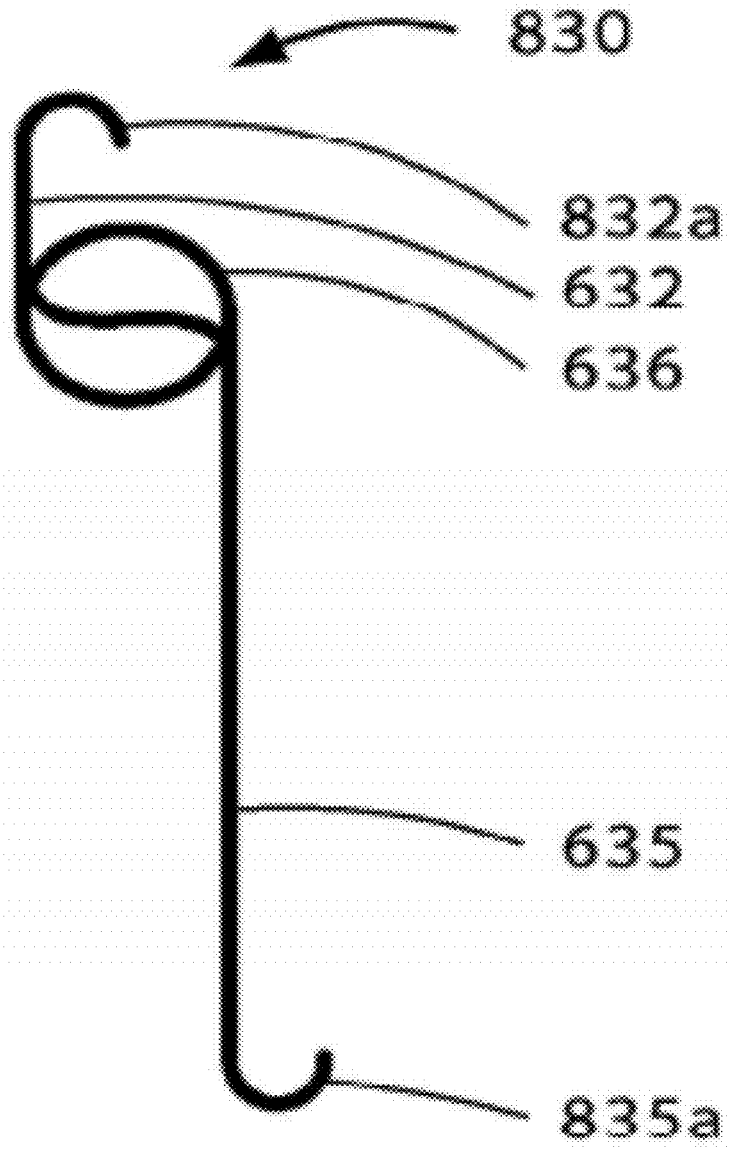
FIG. 17 is an explanatory diagram of a connector 830.

In the above-described second embodiment, the linear shaped first beam 632 and the linear shaped second beam 635 project from different surfaces of the carrier 20. However, as illustrated in FIG. 17, each of a first contact 832*a* of a first beam 832 and a second contact 835*a* of a second beam 835 may be formed into a circular arc shape projecting toward the electrode connected thereto. FIG. 17 is an explanatory diagram of a connector 830. With this configuration, the connection status between the connector 830 and the electrodes is easily stabilized. If an excess force is applied to the electrodes, damage to the electrodes can be reduced.

In the above-described second embodiment, the connector 630 is formed by a single wire rod. However, the configuration is not particularly limited thereto. Thus, the connector 630 may be formed by two or more wire rods connected together, or may be formed by a wire rod and a flat plate. Further, the first beam 632 and the second beam 635 are formed into a rod shape. However, the first beam 632 and the second beam 635 may be formed into a flat plate shape, similarly to the above-described first embodiment. Further, the connector 630 may be configured as a connector having a shape bent into a cantilever-like, substantially C-shape provided with the coil-like regulating portion 636.

In the above-described second embodiment, the movement of the connector 630 is regulated by the spring force of the coil-like regulating portion 636. However, the configuration is not particularly limited thereto. Thus, the movement of the connector 630 may be regulated by the spring force of a plate spring-like regulating portion. This configuration is also capable of more reliably fixing the connector 630 and the carrier 20 to each other, and providing an electrical connection body which is easier to produce.

Each of the electrical connection bodies of the above-described embodiments is used, being installed in an inspection device which inspects the state of electrical connection between the first device 12 and the second device 16. However, the use of the electrical connection body is not particularly limited thereto, as long as the electrical connection body electrically connects first and second devices.

Needless to say, the present invention is not limited at all to the above-described embodiments, and can be implemented in a variety of forms, as long as within the technical scope of the present invention. Further, the configuration of the first embodiment and the configuration of the second embodiment may be combined as appropriate.

This specification refers to Japanese Patent Application No. 2008-262493 filed for patent in Japan on Oct. 9, 2008, and Japanese Patent Application No. 2009-197371 filed for patent in Japan on Aug. 27, 2009, the disclosed specification, drawings, and claims of which are entirely incorporated herein by reference.

What is claimed is:

1. An electrical connection body which electrically connects facing electrodes between two devices, the connection body comprising:

a carrier including a through-hole and a wall portion provided upright in the vicinity of the through-hole in a forming direction of the through-hole, wherein the carrier has two exposed outwardly opposite facing surfaces with a slot formed in at least one of the surfaces to form the wall portion; and a connector including a first beam having a first contact connected to one of the facing electrodes, a second beam having a second contact connected to the other one of the facing electrodes, a connecting portion having one end provided with the first beam and the other end provided with the second beam, and a regulating portion provided to the connecting portion and configured to come into contact with the wall portion to regulate the movement of the connecting portion, the connector having the connecting portion inserted in the through-hole with the first beam and the second beam projecting from the two exposed outwardly opposite facing surfaces of the carrier, respectively, wherein the regulating portion contacts the wall portion to regulate the axial rotation of the connector, and wherein at least one of the first beam and the second beam is bent with respect to the connecting portion and is in contact with an opening portion of the through-hole along at least one of the two exposed outwardly opposite facing surfaces of the carrier, to regulate the movement of the connector in the forming direction of the through-hole.

2. The electrical connection body according to claim 1, wherein each of the first contact of the first beam and the second contact of the second beam is formed into a circular arc shape projecting toward the electrode connected thereto.

3. The electrical connection body according to claim 1, wherein, in the carrier, the wall portion is formed by a wall surface of a groove portion provided to overlap with a part of the through-hole.

4. The electrical connection body according to claim 1, wherein, in the carrier, the through-hole is formed in a plurality, and the connector is inserted in each of the plurality of through-holes.

5. The electrical connection body according to claim 1, wherein, in the connector, the regulating portion is provided to the first beam side of the connecting portion, and the connecting portion side of the second beam is bent into an S-shape and in contact with an opening portion of the through-hole with at least a part of the S-shape located in the interior of the through-hole.

6. The electrical connection body according to claim 1, wherein, in the connector, the regulating portion is provided to the first beam side of the connecting portion, and the second beam and the connecting portion, before being inserted into the through-hole, are formed into a substantially flat plate shape.

7. The electrical connection body according to claim 1, wherein, in the connector, the regulating portion is provided to the first beam side of the connecting portion, and wherein, in the carrier, an opening portion of the through-hole provided to the first beam side is formed to be larger than an opening portion of the through-hole provided to the second beam side.

8. The electrical connection body according to claim 1, wherein, in the carrier, the wall portion is formed on both sides of the through-hole, and wherein, in the connector, the regulating portion being a plate-like body is provided on both sides of the connecting portion.

9. The electrical connection body according to claim 8, wherein, in the connector, the plate-like body is provided to be inclined from the connecting portion toward the wall portion.

10. The electrical connection body according to claim 1, wherein the connector includes the regulating portion having a coil shape and applying spring force to the wall portion in the carrier to regulate the movement of the connecting portion.

11. The electrical connection body according to claim 10, wherein, in the connector, a single wire rod forms the first beam, the second beam, the connecting portion, and the regulating portion.

12. The electrical connection body according to claim 10, wherein, in the connector, the first beam having a linear shape and the second beam having a linear shape project from the two exposed outwardly opposite facing surfaces of the carrier.

* * * * *